US007832170B2

(12) United States Patent
Zeigler

(10) Patent No.: US 7,832,170 B2
(45) Date of Patent: Nov. 16, 2010

(54) EXPANDABLE AND COLLAPSIBLE STRUCTURES INCLUDING SPLIT SCISSOR ASSEMBLY

(75) Inventor: Theodore R. Zeigler, Alexandria, VA (US)

(73) Assignee: World Shelters, Inc., Alexandria, VA (US)

( * ) Notice: Subject to any disclaimer, the term of this patent is extended or adjusted under 35 U.S.C. 154(b) by 1825 days.

(21) Appl. No.: 10/779,641

(22) Filed: Feb. 18, 2004

(65) Prior Publication Data

US 2005/0194032 A1 Sep. 8, 2005

(51) Int. Cl.
*E04H 15/46* (2006.01)

(52) U.S. Cl. ..... 52/646; 52/645; 52/79.5; 135/97; 135/121; 135/131; 135/135; 135/145; 135/159

(58) Field of Classification Search ..... 52/63, 52/79.5, 645, 646; 135/97, 121, 131, 135, 135/145, 159
See application file for complete search history.

(56) References Cited

U.S. PATENT DOCUMENTS 3,968,808 A 7/1976 Zeigler
4,026,313 A 5/1977 Zeigler
4,280,521 A 7/1981 Zeigler
4,290,244 A 9/1981 Zeigler
4,334,660 A 6/1982 Zeigler
4,437,275 A 3/1984 Zeigler
4,473,986 A 10/1984 Zeigler
4,512,097 A 4/1985 Zeigler
4,522,008 A 6/1985 Zeigler
4,561,618 A 12/1985 Zeigler
4,579,066 A 4/1986 Zeigler
4,637,180 A 1/1987 Zeigler
4,666,102 A 5/1987 Zeigler et al.
4,689,932 A 9/1987 Zeigler
4,747,239 A 5/1988 Zeigler
4,761,929 A 8/1988 Zeigler
4,800,663 A 1/1989 Zeigler
4,838,003 A 6/1989 Zeigler
4,970,841 A 11/1990 Zeigler
RE33,710 E 10/1991 Zeigler
5,230,196 A 7/1993 Zeigler
5,274,980 A 1/1994 Zeigler
5,444,946 A 8/1995 Zeigler (Continued)

*Primary Examiner*—Richard E Chilcot, Jr.
*Assistant Examiner*—Beth Stephan
(74) *Attorney, Agent, or Firm*—WRB IP LLP

(57) ABSTRACT

An expandable and collapsible structure and an expandable and collapsible scissor assembly and module therefor are provided. The scissor assembly includes a first strut having a first end and a second end. The scissor assembly also includes a second strut upper portion having a first end and a second end, the first end of the second strut upper portion being pivotably connected to the first strut at an upper strut connection point, and a second strut lower portion having a first end and a second end, the second end of the second strut lower portion being pivotably connected to the first strut at a lower strut connection point. The lower strut connection point is between the upper strut connection point and the first end of the first strut and the scissor assembly is movable between a folded position in which the first end of the first strut and the second end of the second strut upper portion are substantially adjacent and the second end of the first strut and the first end of the second strut lower portion are substantially adjacent, and an expanded position.

23 Claims, 8 Drawing Sheets

U.S. PATENT DOCUMENTS 5,651,228 A 7/1997 Zeigler
5,794,640 A * 8/1998 Jang ..... 135/131
6,141,934 A 11/2000 Zeigler
2002/0189659 A1* 12/2002 Carter ..... 135/145

* cited by examiner

EXPANDABLE AND COLLAPSIBLE STRUCTURES INCLUDING SPLIT SCISSOR ASSEMBLY

BACKGROUND AND SUMMARY

The present invention relates to expandable and collapsible structures and, more particularly, to such structures including split scissor assemblies.

My prior U.S. Pat. Nos. 6,141,934, 5,651,228, 5,444,946, 5,274,980, 5,230,196, RE33,710, U.S. Pat. Nos. 4,970,841, 4,838,003, 4,800,663, 4,761,929, 4,747,239, 4,689,932, 4,666,102, 4,637,180, 4,579,066, 4,561,618, 4,522,008, 4,512,097, 4,473,986, 4,437,275, 4,334,660, 4,290,244, 4,280,521, 4,026,313, and 3,968,808 are incorporated by reference and show various collapsible structures and components therefore. Many collapsible structures have sloped side walls. These sloped side walls can be disadvantageous because they do not permit usage of all of the space within the structure, particularly near bottom corners of the structure. Also, these structures do not "complex" or arrange adjacent to one another in a connected fashion as structures having vertical walls which can be connected to one another to form larger structures.

My U.S. Pat. No. 5,230,196 discloses one approach to providing collapsible structures with substantially vertical walls. In structures made according to this patent, interconnected modules form a dome or peak using struts that are joined to one another in a scissor-like manner with pivot pins located at points offset from the longitudinal centers of the struts. The amount of rise that is achieved by a given module depends upon where the struts are joined to one another. One shortcoming of structures where struts are joined off-center is that it can be difficult to arrange the struts so that the structure can be conveniently folded.

My U.S. Pat. No. 5,274,980 discloses a solution to the problem of off-center joining of struts and provides a module including a split scissor. To facilitate folding, at least one strut of the scissor is telescopic. The telescopic strut adds a degree of complexity to the structure.

My U.S. Pat. No. 6,141,934 discloses yet another structure. In this structure, modules are not only formed with struts that intersect one another at points remote from the longitudinal centers of the struts, the modules are pivotably connected to vertical leg members at an upper side of the module and are supported by a telescoping member. This structure is also somewhat complex.

It is desirable to provide an expandable and collapsible structure that includes a plurality of interconnected modules that can be arranged relative to one another to form a peaked structure. It is also desirable to provide an expandable and collapsible structure having vertical side walls.

In accordance with an aspect of the present invention, an expandable and collapsible scissor assembly for an expandable and collapsible structure includes a first strut having a first end and a second end. The assembly also includes a second strut upper portion having a first end and a second end, the first end of the second strut upper portion being pivotably connected to the first strut at an upper strut connection point, and a second strut lower portion having a first end and a second end, the second end of the second strut lower portion being pivotably connected to the first strut at a lower strut connection point. The lower strut connection point is between the upper strut connection point and the first end of the first strut and the scissor assembly is movable between a folded position in which the first end of the first strut and the second end of the second strut upper portion are substantially adjacent and the second end of the first strut and the first end of the second strut lower portion are substantially adjacent, and an expanded position.

In accordance with another aspect of the present invention, an expandable and collapsible structural module is provided. The module includes a left and a right split scissor assembly, each split scissor assembly including a first strut having a first end and a second end, a second strut upper portion having a first end and a second end, the first end of the second strut upper portion being pivotably connected to the first strut at an upper strut connection point, a second strut lower portion having a first end and a second end, the second end of the second strut lower portion being pivotably connected to the first strut at a lower strut connection point, wherein the lower strut connection point is between the upper strut connection point and the first end of the first strut. The module also includes a front and a back scissor assembly, each scissor assembly including a first scissor strut and a second scissor strut, the front and back first scissor struts each having a first end connected to the second end of the left second strut upper portion and the first end of the left first strut, respectively, and a second end connected to the second end of the right first strut and the first end of the right second strut lower portion, respectively, and the front and back second scissor struts each having a first end connected to the second end of the left first strut and the first end of the left second strut lower portion, respectively, and a second end connected to the second end of the right second strut upper portion and the first end of the right first strut, respectively.

In accordance with still another aspect of the present invention, an expandable and collapsible structure is provided. The structure includes a plurality of expandable and collapsible structural modules. Each module includes a left and a right split scissor assembly, each split scissor assembly including a first strut having a first end and a second end. Each module also includes a second strut upper portion having a first end and a second end, the first end of the second strut upper portion being pivotably connected to the first strut at an upper strut connection point, and a second strut lower portion having a first end and a second end, the second end of the second strut lower portion being pivotably connected to the first strut at a lower strut connection point. The lower strut connection point is between the upper strut connection point and the first end of the first strut. Each module also includes a front and a back scissor assembly. Each scissor assembly includes a first scissor strut and a second scissor strut, the front and back first scissor struts each having a first end connected to the second end of the left second strut upper portion and the first end of the left first strut, respectively, and a second end connected to the second end of the right first strut and the first end of the right second strut lower portion, respectively. The front and back second scissor struts each have a first end connected to the second end of the left first strut and the first end of the left second strut lower portion, respectively, and a second end connected to the second end of the right second strut upper portion and the first end of the right first strut. For at least one pair of the modules, the modules are connected to one another in that a second end of a second strut upper portion and a second end of a first strut of a left split scissor assembly of one module is connected to a second strut upper portion and a second end of a first strut of a right split scissor assembly of another module.

In accordance with still another aspect of the present invention, an expandable and collapsible structural module is provided. The module includes a left and a front split scissor assembly, each split scissor assembly including a first strut having a first end and a second end, a second strut upper portion having a first end and a second end, the first end of the second strut upper portion being pivotably connected to the first strut at an upper strut connection point, a second strut lower portion having a first end and a second end, the second end of the second strut lower portion being pivotably connected to the first strut at a lower strut connection point, wherein the lower strut connection point is between the upper strut connection point and the first end of the first strut. Each modules also includes a right and a back scissor assembly, each scissor assembly including a first scissor strut and a second scissor strut, the right and back first scissor struts each having a first end connected to the second end of the left second strut upper portion and the first end of the left first strut, respectively, and a second end connected to the second end of the front first strut and the first end of the front second strut lower portion, respectively, and the right and back second scissor struts each having a first end connected to the second end of the left first strut and the first end of the left second strut lower portion, respectively, and a second end connected to the second end of the front second strut upper portion and the first end of the front first strut.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
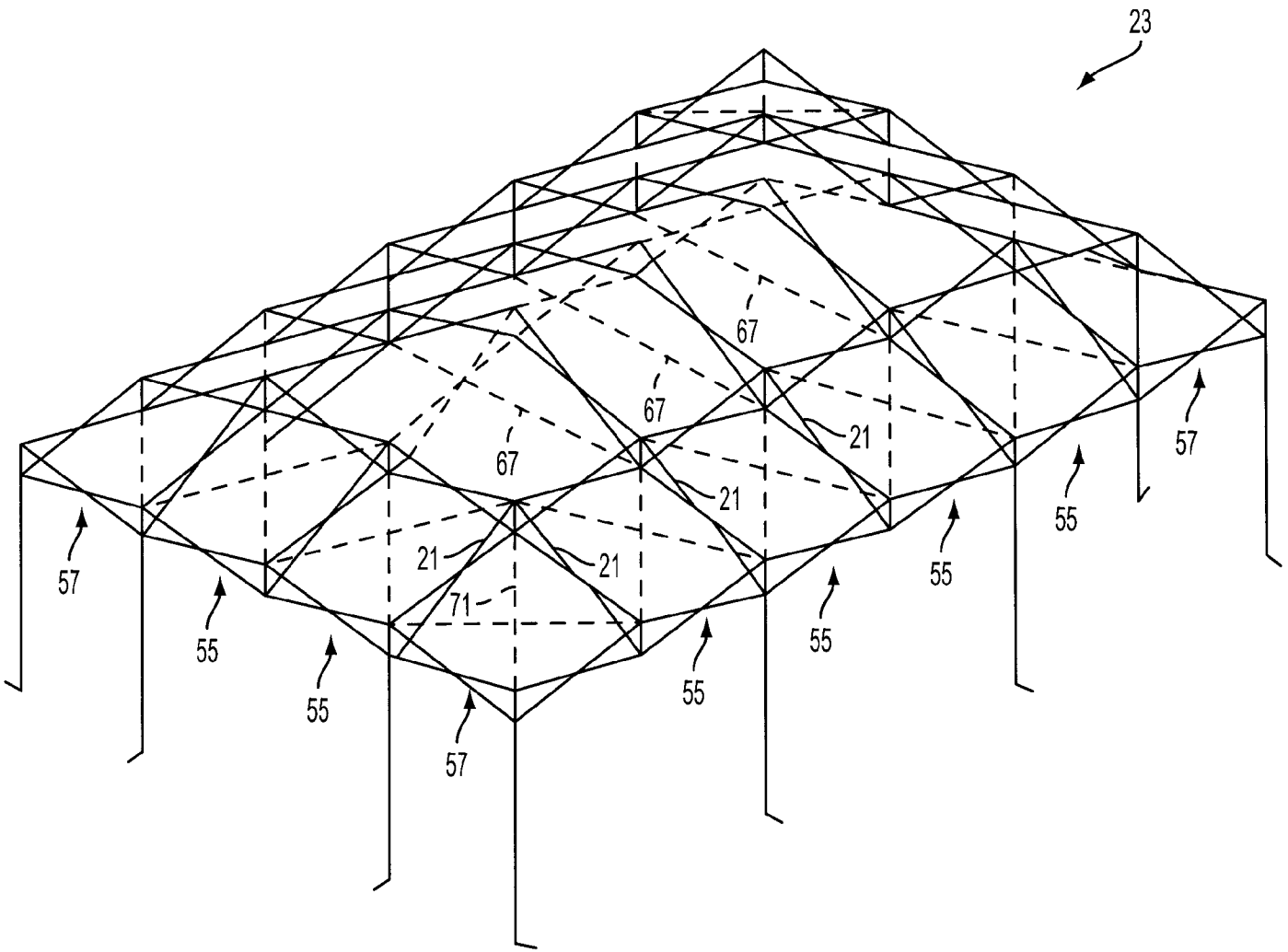
FIG. 1 is a perspective view of an expandable and collapsible structure according to an embodiment of the present invention.

An expandable and collapsible split scissor assembly 21 for an expandable and collapsible structure 23 is seen in FIG. 1. The split scissor assembly 21 is shown isolated in FIGS. 2A and 2B.

The split scissor assembly 21 includes a first strut 25 having a first end 25' and a second end 25". The split scissor assembly 21 also includes a second strut upper portion 27 having a first end 27' and a second end 27". The first end 27' of the second strut upper portion 27 is pivotably connected to the first strut 25 at an upper strut connection point 29, ordinarily by a pivot pin. Struts such as the first strut and the second strut upper portion 27 are ordinarily light weight aluminum rods.

The split scissor assembly 21 also includes a second strut lower portion 31 having a first end 31' and a second end 31". The second end 31" of the second strut lower portion 31 is pivotably connected to the first strut 27 at a lower strut connection point 33. The lower strut connection point 33 is between the upper strut connection point 29 and the first end 27' of the first strut 27.

Figure 2A:
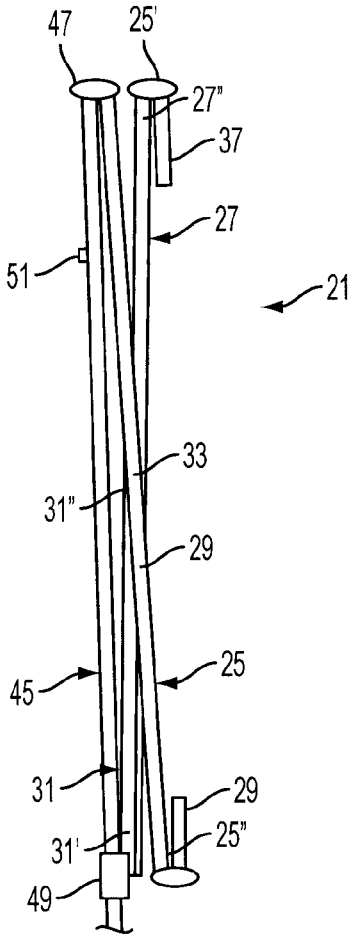
FIGS. 2A and 2B are side views of a split scissor assembly according to an embodiment of the present invention in a folded and an expanded condition, respectively.
Figure 2B:
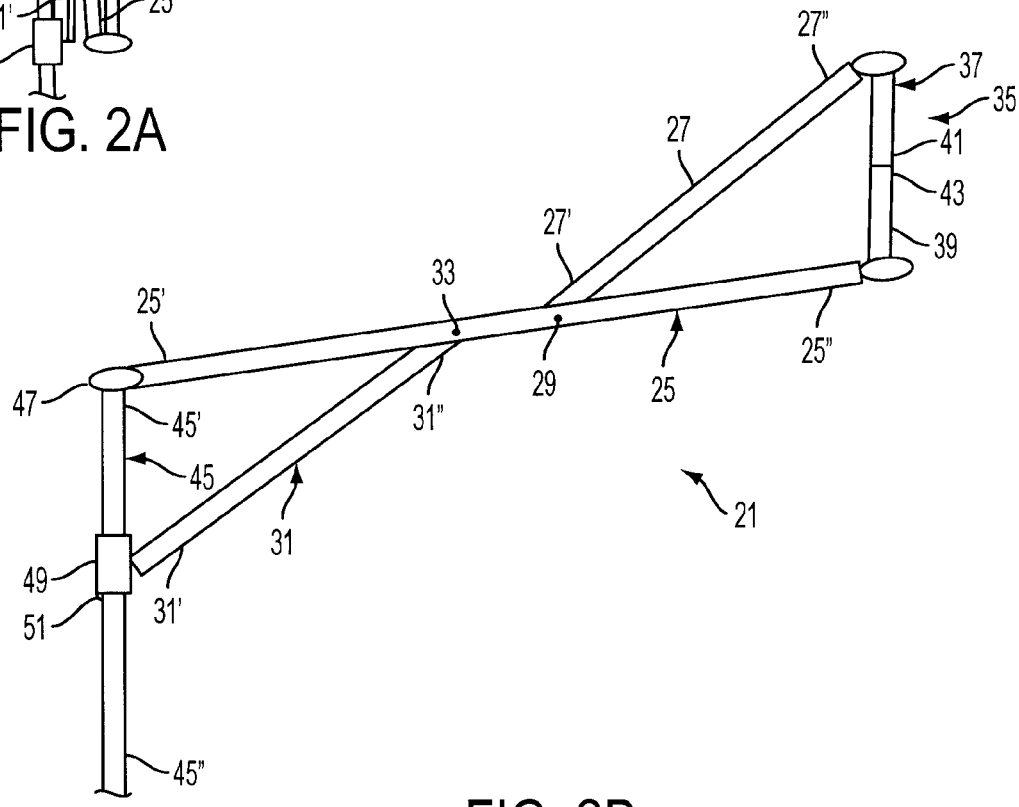

The split scissor assembly 21 is movable between a folded position (FIG. 2A) in which the first end 25' of the first strut 25 and the second end 27" of the second strut upper portion 27 are substantially adjacent and the second end 25" of the first strut and the first end 31" of the second strut lower portion 31 are substantially adjacent, and an expanded position (FIG. 2B). When the split scissor assembly 21 is in the expanded position, the first end 25' of the first strut 25 and the first end 31' of the second strut lower portion 31 are disposed proximate each other and the second end 25" of the first strut and the second end 27" of the second strut upper portion are disposed proximate each other. Proximate, in the sense used here, means that the strut ends are close but not necessarily adjacent to one another and is meant to contrast with the situation where the strut ends are particularly remote. For example, when the split scissor assembly 21 is in the folded position, the first end 25' of the first strut 25 is at substantially the opposite end of the assembly from the first end 31' of the second strut lower portion 31 and those ends are not proximate in the sense used here.

Frequently, when the strut ends are proximate one another, they will be locked at a predetermined distance relative to one another. To this end, a lock 35 for locking at least one of the first end 25' of the first strut 25 and the first end 31' of the second strut lower portion 3 land the second end 25" of the first strut and the second end 27" of the second strut upper portion 27 proximate each other is provided for when the split scissor assembly 21 is in the expanded position.

A suitable form of lock 35 includes an upper hub 37 and a lower hub 39 pivotably connected to the at least one of the first end 25' of the first strut 25 and the first end 31' of the second strut lower portion 31 and the second end 25" of the first strut and the second end 27" of the second strut upper portion 27. A variety of hub forms can be used, such as the form of the hub disclosed in U.S. Pat. No. 5,444,946. The upper hub 37 and the lower hub 39 include mating members 41 and 43, respectively, for securing the upper hub and the lower hub proximate each other. The mating members 41 and 43 may be any suitable mating members, such as the portions of the compression lock disclosed in U.S. Pat. No. 5,444,946.

Figure 3:
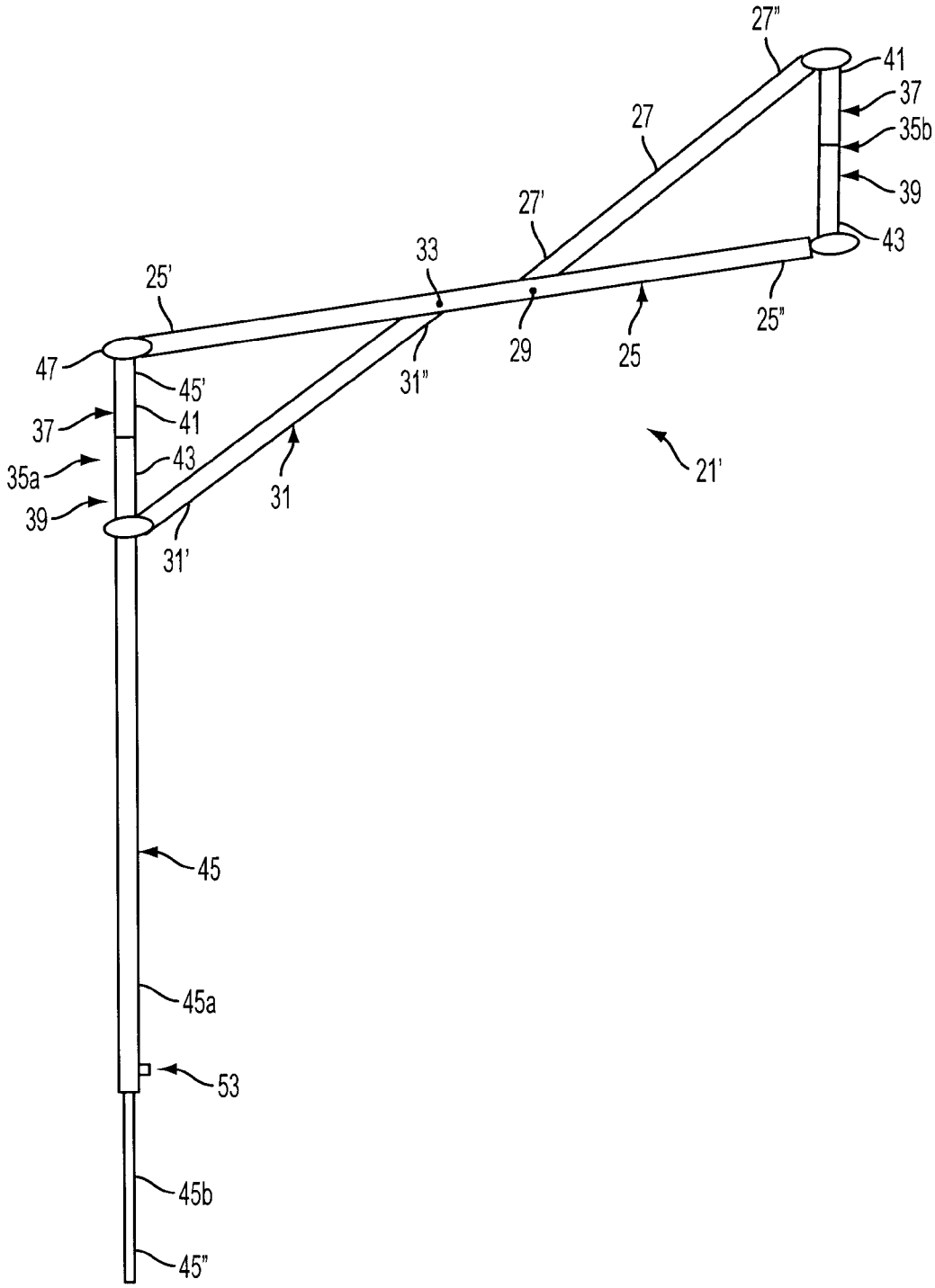
FIG. 3 is a side view of a split scissor assembly according to another embodiment of the present invention.

In the embodiment of the split scissor assembly 21' shown in FIG. 3, the first end 25' of the first strut 25 and the first end 31' of the second strut lower portion 31 are locked by a first lock 35*a* and the second end 25" of the first strut and the second end 27" of the second strut upper portion 27 is locked by a second lock 35*b*. The first and second locks 35*a* and 35*b* may be substantially identical.

In the embodiment of the split scissor assembly 21 shown in FIGS. 2A and 2B, only one lock 35 is provided. The lock 35 includes a lower hub 39 and an upper hub 37 pivotably connected to the second end 25" of the first strut 25 and the second end 27" of the second strut upper portion 27, respectively.

The split scissor assembly 21 also includes a leg 45 having an upper end 45' and a lower end 45". The first end 25' of the first strut 25 is pivotably connected to the upper end 45' of the leg 45, such as by a hub 47 fixed at the upper end of the leg.

The first end 31' of the second strut lower portion 31 is pivotably and slidably connected to the leg 45 between the upper end 45' and the lower end 45". The first end 31' of the second strut lower portion 31 can be pivotably and slidably connected to the leg 45 by a sliding hub 49 having a central opening through which the leg can slide. The sliding hub 49 can be permitted to move freely relative to the leg 45 at all times or can be fixed partially or completely in place by a suitable leg lock 51, such as a spring loaded protrusion that extends from a hole in the leg and mates with a recess in the sliding hub or otherwise prevents the sliding hub from descending on the leg.

As seen in FIG. 3, the leg 45 can be telescopic, with the upper end 45' being disposed on a first portion 45*a* of the leg and the lower end 45" being disposed on a second portion 45*b* of the leg that is at least partially receivable inside of the first portion of the leg. A locking arrangement 53 such as a spring loaded protrusion that extends from a hole in the second portion 45*b* of the leg 45 into a recess or hole in the first portion 45*a* can be provided to lock the legs in telescoped or untelescoped positions.

In the embodiment shown in FIG. 2B, when the split scissor assembly 21 is in the expanded condition and the leg 45 is vertical, the second end 27" of the second strut upper portion 27 is disposed vertically above the second end 25" of the first strut 25. Also, if the first end 25' of the first strut 25 is disposed vertically above the first end 31' of the second strut lower portion 31 when the split scissor assembly 21 is in its expanded condition, the second end 27" of the second strut upper portion 27 is disposed vertically above the second end 25" of the first strut.

Figure 4A:
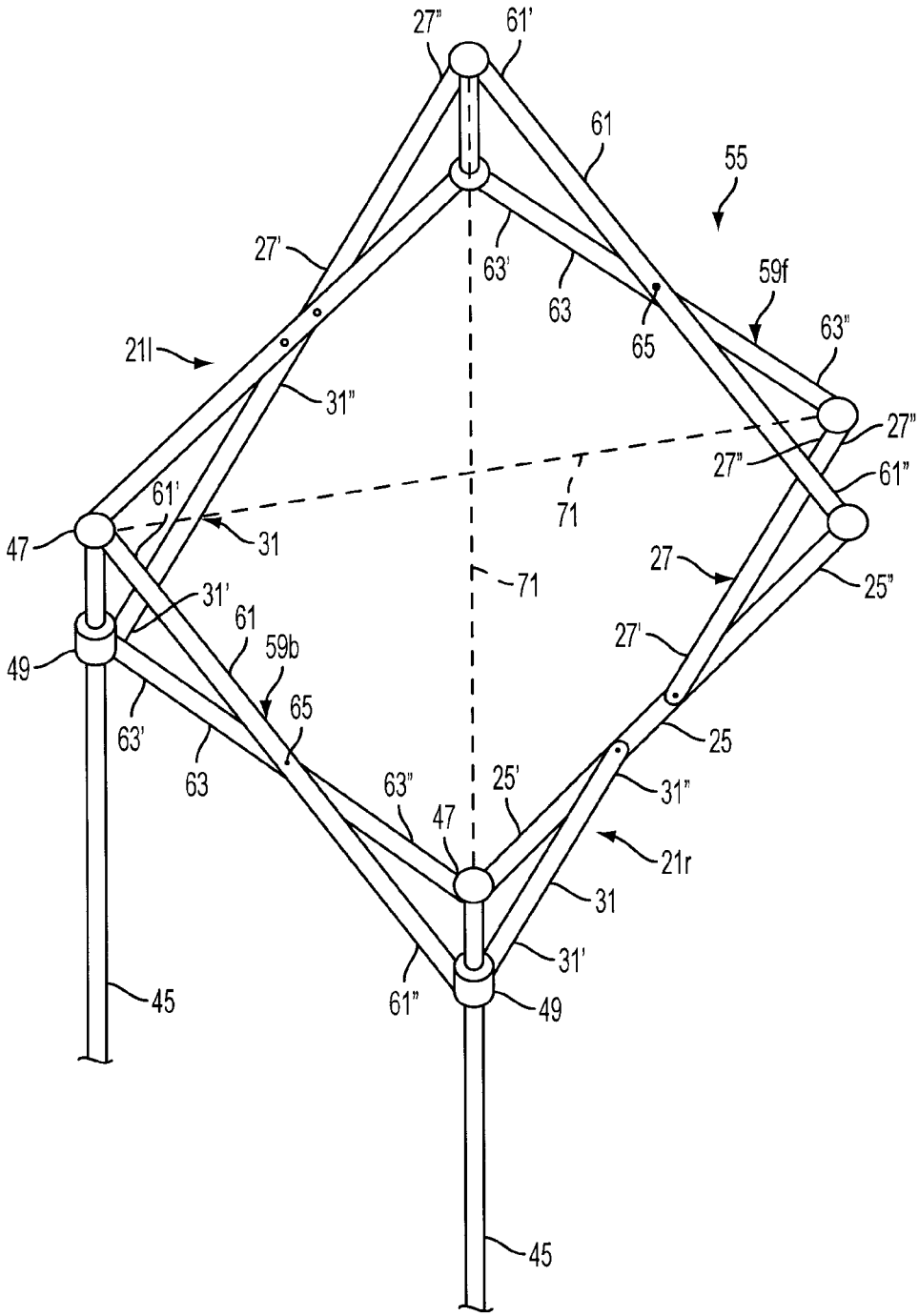
FIGS. 4A and 4B are perspective views of an expandable and collapsible module according to an embodiment of the present invention in an expanded and a folded condition, respectively.
Figure 4B:
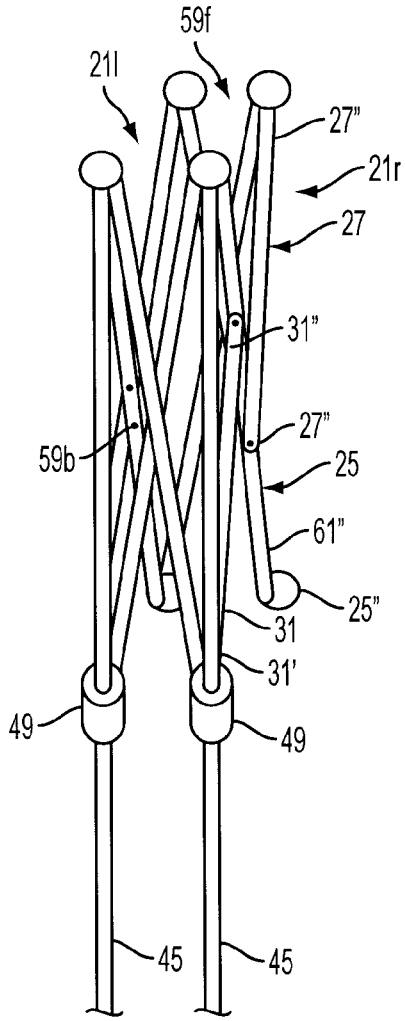
Figure 5:
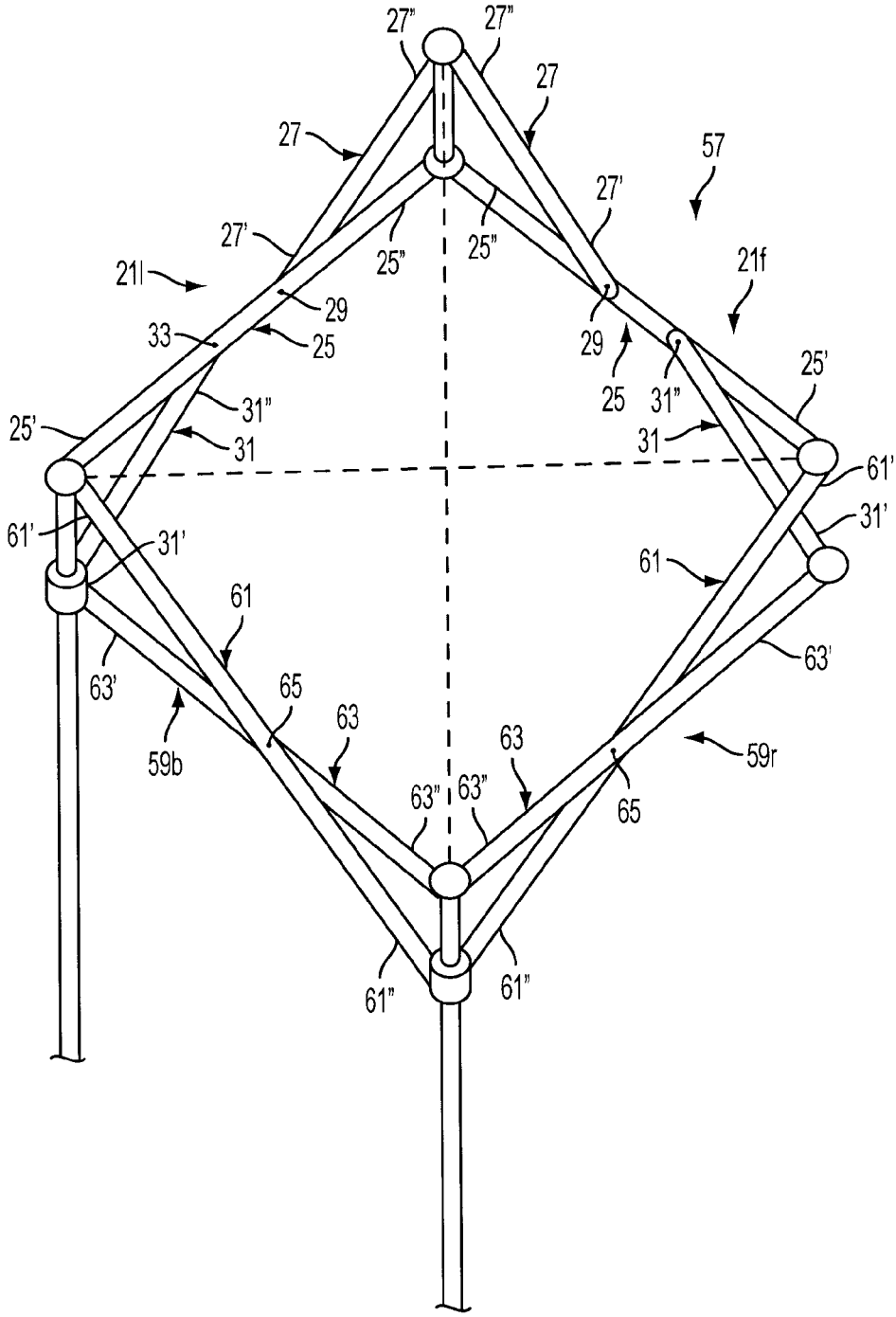
FIG. 5 is a perspective view of an expandable and collapsible module according to another embodiment of the present invention in an expanded condition.

As seen in FIGS. 4A and 4B and FIG. 5, the split scissor assembly 21 can be used to make a variety of expandable and collapsible structural modules 55 and 57, respectively. The module 55 shown in FIGS. 4A and 4B includes a left and a right split scissor assembly 21*l* and 21*r* that may have the structure of the split scissor assembly 21 described in connection with FIGS. 2A and 2B or 3. A front and a back scissor assembly 59*f* and 59*b* are provided.

Each scissor assembly 59*f* and 59*b* includes a first scissor strut 61 and a second scissor strut 63. The first and second scissor struts 61 and 63 may be pivotably connected at a connection point 65. The front and back first scissor struts 61 each have a first end 61' connected to the second end 27" of the second strut upper portion 27 of the left split scissor assembly 21*l* and the first end 25' of the first strut 25 of the left split scissor, respectively. The front and back first scissor struts 61 also each have a second end 61" connected to the second end 25" of the first strut 25 of the right split scissor assembly and the first end 31' of the second strut lower portion 31, respectively.

The front and back second scissor struts 63 each have a first end 63' connected to the second end 25" of the first strut 25 of the left split scissor assembly 21*l* and the first end 31" of the second strut lower portion 31 of the left split scissor member, respectively. A second end 63" of the front and back second scissor struts 63 is connected to the second end 27" of the right second strut upper portion 27 of the right split scissor assembly 21*r* and the first end 25' of the first strut 25 of the right split scissor assembly, respectively.

As with the split scissor assembly 21 and 21', for both the left and a right split scissor assemblies 21*l* and 21*r*, the split scissor assembly is movable between a split scissor folded position (FIG. 4B) in which the first end 25' of the first strut 25 and the second end 27" of the second strut upper portion 27 are substantially adjacent and the second end 25" of the first strut and the first end 31' of the second strut lower portion 31 are substantially adjacent, and a split scissor expanded position (FIG. 4A). For both the front and the back scissor assemblies 59*f* and 59*b*, the scissor assembly is movable between a scissor folded position (FIG. 4B) in which the first end 61' of the first scissor strut 61 and the second end 63" of the second scissor strut 63 are substantially adjacent and the second end 61" of the first scissor strut and the first end 63' of the second scissor strut are substantially adjacent, and a scissor expanded position (FIG. 4A). If desired, the left and right split scissor assemblies 21*l* and 21*r* can be folded and expanded independently of the front and back scissor assemblies 59*f* and 59*b*, and vice versa.

The structural module 57 shown in FIG. 5 is generally similar to the structural module 55 of FIGS. 4A and 4B except that split scissor assemblies 21*l* and 21*f* are located at what will, for purposes of this discussion, be denominated as the left and front sides of the module, while regular scissor assemblies 59*b* and 59*r* are located at the back and right sides of the module. The module 57 is particularly well suited for use at the comers of collapsible structures 23 such as the structure shown in FIG. 1.

The module 57 includes the left and the front split scissor assemblies 21*l* and 21*f*. Each split scissor assembly 21*l* and 21*f* includes a first strut 25 having a first end 25' and a second end 25". Each split scissor assembly 21*l* and 21*f* also includes a second strut upper portion 27 having a first end 27' and a second end, 27", the first end 27' being pivotably connected to the first strut 25 at an upper strut connection point 29. Each split scissor assembly 21*l* and 21*f* also includes a second strut lower portion 31 having a first end 31' and a second end 31", the second end 31" being pivotably connected to the first strut 25 at a lower strut connection point 33. The lower strut connection point 33 is between the upper strut connection point 29 and the first end 25' of the first strut 25.

The module 57 also includes the right and a back scissor assemblies 59*r* and 59*b*. Each scissor assembly 59*r* and 59*b* includes a first scissor strut 61 and a second scissor strut 63. The first scissor struts 61 of the right and back scissor assemblies 59*r* and 59*b* each have a first end 61' connected to the first end 25' of the first strut 25 of the front and left split scissor assemblies 21*f* and 21*l*. The first scissor struts 61 of the right and back scissor assemblies 59*r* and 59*b* each have a second end 61" connected to each other. The second scissor struts 63 of the right and back scissor assemblies 59*r* and 59*b* each have a first end 63' connected to the first end 31' of the second strut lower portion 31 of the front and left split scissor assemblies 21*f* and 21*l*. The second scissor struts 63 of the right and back scissor assemblies each have a second end 63" connected to each other.

The expandable and collapsible structure 23 shown in FIG. 1 includes a plurality of expandable and collapsible structural modules 55 and a plurality of expandable and collapsible structural modules 57. The modules 57 are disposed at the corners of the structure 23. For at least one pair of the modules 55 and/or 57, the modules are connected to one another in that a second end of a second strut upper portion 27 and a second end of a first strut 25 of a split scissor assembly (e.g., a left split scissor assembly) of one module is connected to a second end of a second strut upper portion 27 and a second end of a first strut 25 of a split scissor assembly (e.g., a right split scissor assembly) of another module.

Adjacent ones of the modules 55 and 57 share split scissor assemblies and/or scissor assemblies. In the embodiment of FIG. 1, a left split scissor assembly of one module 55 is a right split scissor assembly of another module 55. Also, a front scissor of one module 55 is a front scissor of another module 55. Depending upon the configuration of the structure 23, scissor assemblies and split scissor assemblies may be shared between a module 55 and a module 57, as well.

The structure 23 illustrated in FIG. 1 is merely one of a substantially infinite variety of structures that can be built according to the present invention. FIGS. 6A, 6B, 7, and 8 are illustrative of other types of structures 23 that can be made according to the present invention.

As will be seen from certain of the structures made according to the present invention, the modules 55 or 57 may only be disposed around a periphery of the structure. The interior of the structure may be left open or may include structure such as are seen in FIG. 1, which shows a series of split scissor assemblies 21 disposed between modules 55. Instead of or in addition to the split scissor assemblies, cables 67 are preferably extended between at least some modules on opposing sides of the structure 23.

Figure 6A:
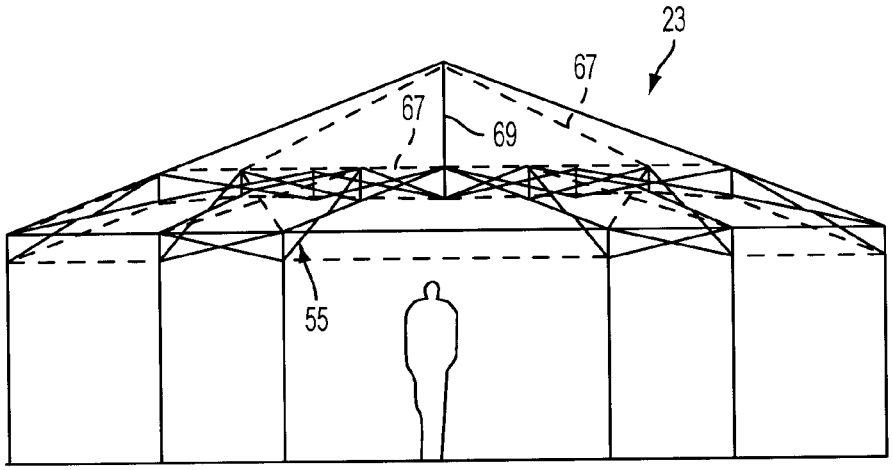
FIGS. 6A and 6B are side and top views of an expandable and collapsible structure according to another embodiment of the present invention.
Figure 6B:
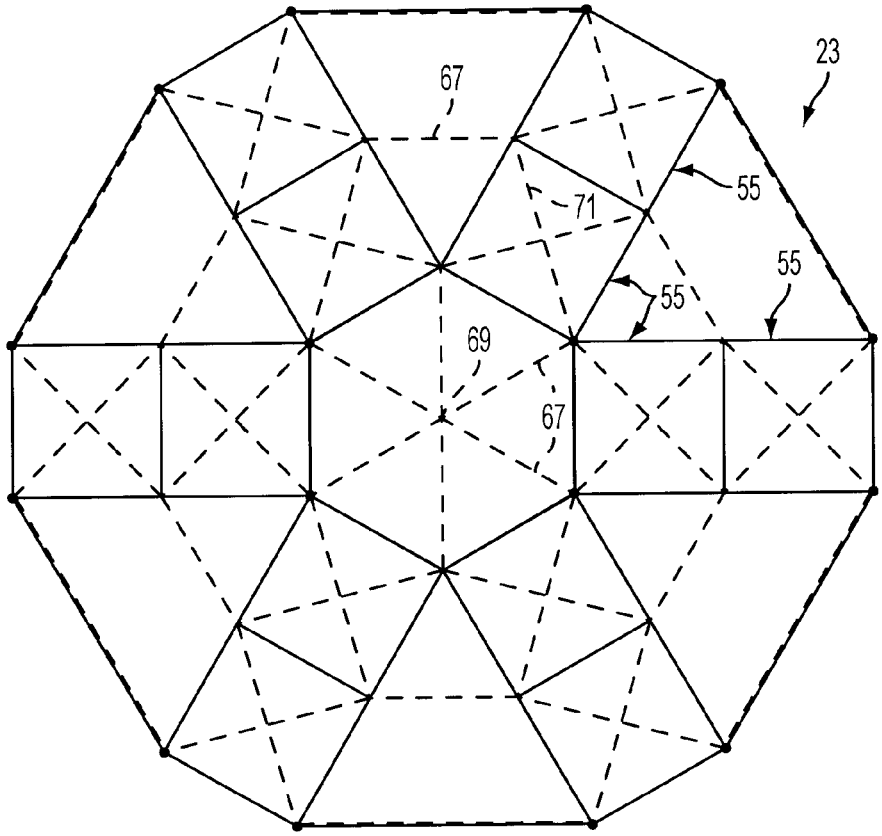
Figure 7:
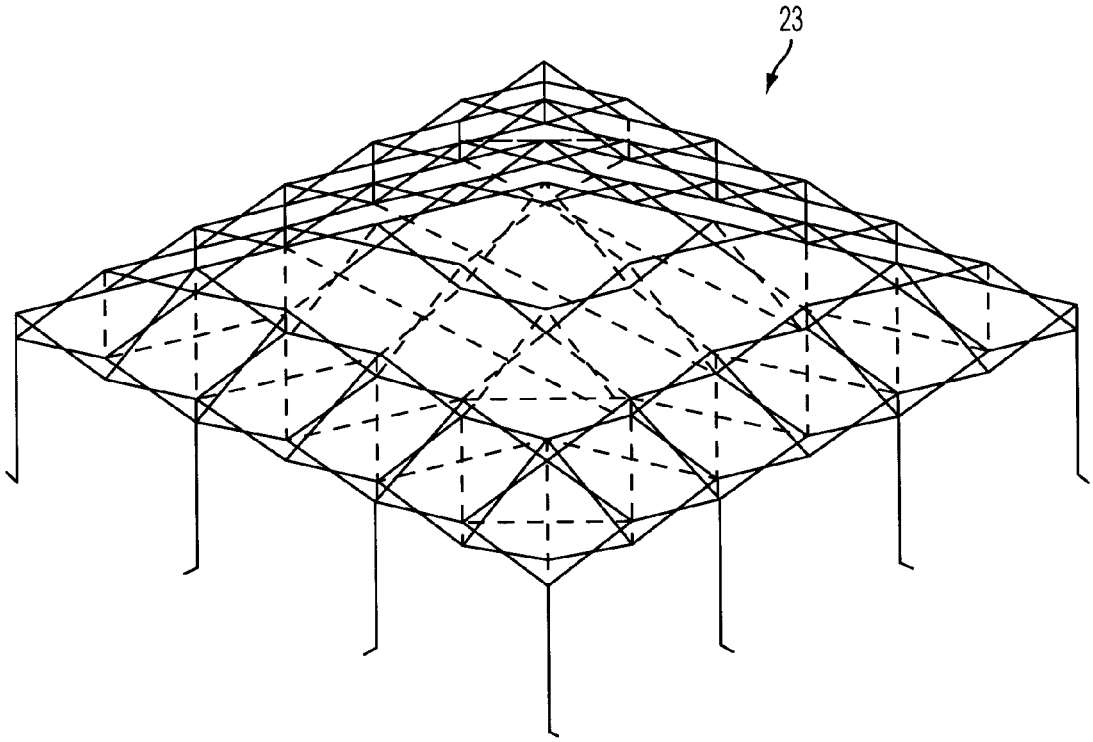
FIG. 7 is a perspective view of an expandable and collapsible structure according to yet another embodiment of the present invention.
Figure 8:
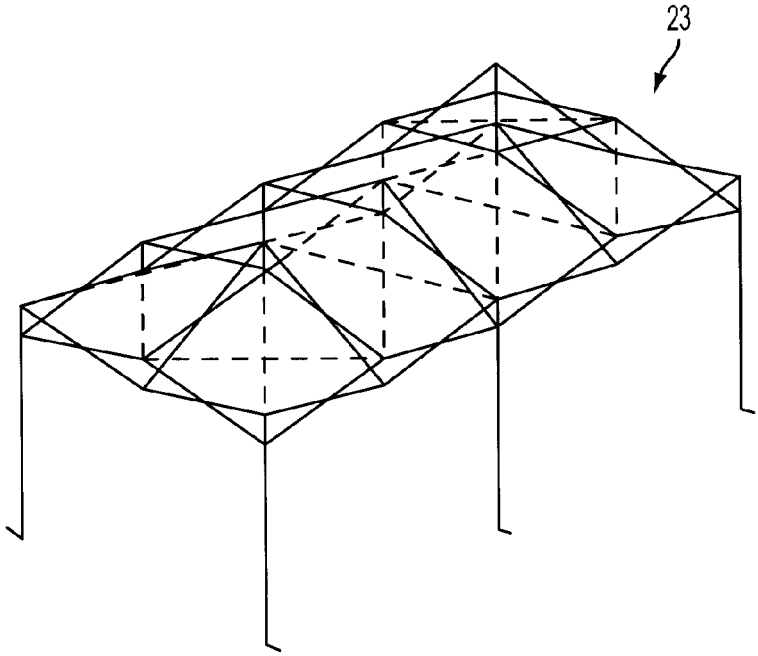
FIG. 8 is a perspective view of an expandable and collapsible structure according to yet another embodiment of the present invention.

Also, as seen in FIGS. 6A and 6B, instead of or in addition to the split scissor assemblies, cables or rigid members can be extended between opposing modules of the structure 23 and can support masts 69 to form a peak at the center of the structure. FIGS. 6A and 6B show, additionally, an embodiment wherein a plurality of modules extends radially outward from a center region instead of merely being disposed around the periphery of the structure.

Although not shown in the figures here, the structures according to the present invention ordinarily also include outer and, ordinarily, inner covers. Because it is possible to make the walls of the structures according to the present invention substantially vertical, it is possible to arrange the structures closely together. Additionally, the vertical walls permit usage of substantially all of the interior space in the structures. The peaked roofs that can be constructed using the split scissor assemblies can prevent buildup of snow or water on the roofs.

Tension members 71 such as cables are preferably provided diagonally across all of the modules 55 and 57. The tension members 71 can provide additional strength to the structures while also permitting the structures to absorb wind and other forces.

While this invention has been illustrated and described in accordance with a preferred embodiment, it is recognized that variations and changes may be made therein without departing from the invention as set forth in the claims.

What is claimed is:

1. An expandable and collapsible scissor assembly for an expandable and collapsible structure, comprising:

a first strut having a first end and a second end;

a second strut upper portion having a first end and a second end, the first end of the second strut upper portion being pivotably connected to the first strut at an upper strut connection point; and a second strut lower portion having a first end and a second end, the second end of the second strut lower portion being pivotably connected to the first strut at a lower strut connection point, wherein the lower strut connection point is between the upper strut connection point and the first end of the first strut and the scissor assembly is movable between a folded position and an expanded position, wherein, when the scissor assembly is in the folded position, the first end of the first strut and the second end of the second strut upper portion are substantially adjacent and the second end of the first strut and the first end of the second strut lower portion are substantially adjacent.

2. The expandable and collapsible scissor assembly as set forth in claim 1, wherein, when the scissor assembly is in the expanded position, the first end of the first strut and the first end of the second strut lower portion are disposed proximate each other and the second end of the first strut and the second end of the second strut upper portion are disposed proximate each other.

3. The expandable and collapsible scissor assembly as set forth in claim 2, further comprising a lock for locking at least one of the first end of the first strut and the first end of the second strut lower portion and the second end of the first strut and the second end of the second strut upper portion proximate each other when the scissor assembly is in the expanded position.

4. The expandable and collapsible scissor assembly as set forth in claim 3, wherein the lock includes an upper hub and a lower hub pivotably connected to the at least one of the first end of the first strut and the first end of the second strut lower portion and the second end of the first strut and the second end of the second strut upper portion.

5. The expandable and collapsible scissor assembly as set forth in claim 4, wherein the upper hub and the lower hub including mating members for securing the upper hub and the lower hub proximate each other.

6. The expandable and collapsible scissor assembly as set forth in claim 3, wherein the first end of the first strut and the first end of the second strut lower portion are locked by a first lock and the second end of the first strut and the second end of the second strut upper portion are locked by a second lock.

7. The expandable and collapsible scissor assembly as set forth in claim 6, wherein the first lock includes an upper hub and a lower hub pivotably connected to the first end of the first strut and the first end of the second strut lower portion, respectively and the second lock includes a lower hub and an upper hub pivotably connected to the second end of the first strut and the second end of the second strut upper portion, respectively.

8. The expandable and collapsible scissor assembly as set forth in claim 7, wherein the upper hub and the lower hub for each of the first and second locks include mating members for securing the upper hub and the lower hub proximate each other.

9. The expandable and collapsible scissor assembly as set forth in claim 3, wherein the lock includes a lower hub and an upper hub pivotably connected to the second end of the first strut and the second end of the second strut upper portion, respectively.

10. The expandable and collapsible scissor assembly as set forth in claim 9, wherein the upper hub and the lower hub for each of the first and second locks include mating members for securing the upper hub and the lower hub proximate each other.

11. The expandable and collapsible scissor assembly as set forth in claim 9, comprising a leg having an upper end and a lower end, the first end of the first strut being pivotably connected to the upper end of the leg and the first end of the second strut lower portion being pivotably and slidably connected to the leg between the upper end and the lower end.

12. The expandable and collapsible scissor assembly as set forth in claim 11, comprising a leg lock for locking the first end of the second strut lower portion proximate the first end of the first strut.

13. The expandable and collapsible scissor assembly as set forth in claim 11, wherein the leg is telescopic, the upper end being disposed on a first portion of the leg and the lower end being disposed on a second portion of the leg at least partially receivable inside of the first portion of the leg.

14. The expandable and collapsible scissor assembly as set forth in claim 11, wherein, when the scissor assembly is in the expanded condition and the leg is vertical, the second end of the second strut upper portion is disposed vertically above the second end of the first strut.

15. The expandable and collapsible scissor assembly as set forth in claim 1, wherein, when the scissor assembly is in the expanded condition and the first end of the first strut is disposed vertically above the first end of the second strut lower portion, the second end of the second strut upper portion is disposed vertically above the second end of the first strut.

16. An expandable and collapsible structural module, comprising:

a left and a right split scissor assembly, each split scissor assembly including a first strut having a first end and a second end, a second strut upper portion having a first end and a second end, the first end of the second strut upper portion being pivotably connected to the first strut at an upper strut connection point, a second strut lower portion having a first end and a second end, the second end of the second strut lower portion being pivotably connected to the first strut at a lower strut connection point, wherein the lower strut connection point is between the upper strut connection point and the first end of the first strut; and a front and a back scissor assembly, each scissor assembly including a first scissor strut and a second scissor strut, the front and back first scissor struts each having a first end connected to the second end of the left second strut upper portion and the first end of the left first strut, respectively, and a second end connected to the second end of the right first strut and the first end of the right second strut lower portion, respectively, and the front and back second scissor struts each having a first end connected to the second end of the left first strut and the first end of the left second strut lower portion, respectively, and a second end connected to the second end of the right second strut upper portion and the first end of the right first strut, respectively;

wherein, for both the left and the right split scissor assembly, the split scissor assembly is movable between a split scissor folded position and a split scissor expanded position, wherein, when the split scissor assembly is in the split scissor folded position, the first end of the first strut and the second end of the second strut upper portion are substantially adjacent and the second end of the first strut and the first end of the second strut lower portion are substantially adjacent.

17. The expandable and collapsible structural module as set forth in claim 16, wherein, for both the front and the back scissor assembly, the scissor assembly is movable between a scissor folded position in which the first end of the first scissor strut and the second end of the second scissor strut are substantially adjacent and the second end of the first scissor strut and the first end of the second scissor strut are substantially adjacent, and a scissor expanded position.

18. The expandable and collapsible structural module as set forth in claim 16, wherein, for both the front and the back scissor assembly, the scissor assembly is movable between a scissor folded position in which the first end of the first scissor strut and the second end of the second scissor strut are substantially adjacent and the second end of the first scissor strut and the first end of the second scissor strut are substantially adjacent, and a scissor expanded position.

19. The expandable and collapsible structural module as set forth in claim 16, wherein the first and second scissor struts are pivotably connected to each other.

20. An expandable and collapsible structure, comprising:

a plurality of expandable and collapsible structural modules, each module comprising a left and a right split scissor assembly, each split scissor assembly including a first strut having a first end and a second end, a second strut upper portion having a first end and a second end, the first end of the second strut upper portion being pivotably connected to the first strut at an upper strut connection point, a second strut lower portion having a first end and a second end, the second end of the second strut lower portion being pivotably connected to the first strut at a lower strut connection point, wherein the lower strut connection point is between the upper strut connection point and the first end of the first strut, a front and a back scissor assembly, each scissor assembly including a first scissor strut and a second scissor strut, the front and back first scissor struts each having a first end connected to the second end of the left second strut upper portion and the first end of the left first strut, respectively, and a second end connected to the second end of the right first strut and the first end of the right second strut lower portion, respectively, and the front and back second scissor struts each having a first end connected to the second end of the left first strut and the first end of the left second strut lower portion, respectively, and a second end connected to the second end of the right second strut upper portion and the first end of the right first strut, wherein, for at least one pair of the modules, the modules are connected to one another in that a second end of a second strut upper portion and a second end of a first strut of a left split scissor assembly of one module is connected to a second strut upper portion and a second end of a first strut of a right split scissor assembly of another module wherein, for both the left and the right split scissor assembly, the split scissor assembly is movable between a split scissor folded position and a split scissor expanded position, wherein, when the split scissor assembly is in the split scissor folded position, the first end of the first strut and the second end of the second strut upper portion are substantially adjacent and the second end of the first strut and the first end of the second strut lower portion are substantially adjacent.

21. The expandable and collapsible structure as set forth in claim 20, wherein, for at least one pair of the modules, a left split scissor assembly of one module is a right split scissor assembly of another module.

22. The expandable and collapsible structure as set forth in claim 21, wherein, for at least one pair of the modules, the modules are connected to one another in that a front scissor of one module is a front scissor of another module.

23. The expandable and collapsible structure as set forth in claim 20, wherein, for at least one pair of the modules, the modules are connected to one another in that a front scissor of one module is a front scissor of another module.

* * * * *